United States Patent [19]

Herdin

[11] Patent Number: 4,641,621

[45] Date of Patent: Feb. 10, 1987

[54] FUEL INJECTION NOZZLE FOR INTERNAL COMBUSTION ENGINES

[75] Inventor: Günther Herdin, Steyr, Austria

[73] Assignee: Steyr-Daimler-Puch AG, Vienna, Austria

[21] Appl. No.: 741,609

[22] Filed: Jun. 5, 1985

[30] Foreign Application Priority Data

Jun. 6, 1984 [AT] Austria ..... 1857/84

[51] Int. Cl.[4] ..... F02M 57/02

[52] U.S. Cl. ..... 123/446; 239/533.3; 239/533.4

[58] Field of Search ..... 123/446, 445, 504; 239/533.3–533.12

[56] References Cited

U.S. PATENT DOCUMENTS

| | | | |
|---|---|---|---|
| 4,092,001 | 5/1978 | Hofmann | 239/533.6 |
| 4,136,654 | 1/1979 | Kulke et al. | 123/445 |
| 4,501,245 | 2/1985 | Taira | 123/446 |
| 4,528,951 | 7/1985 | Yamada | 123/446 |

FOREIGN PATENT DOCUMENTS

| | | | |
|---|---|---|---|
| 2711389 | 9/1978 | Fed. Rep. of Germany | 239/533.8 |

*Primary Examiner*—Willis R. Wolfe, Jr.

*Attorney, Agent, or Firm*—Marmorek Guttman & Rubenstein

[57] ABSTRACT

A fuel injection nozzle for internal combustion engines comprises a nozzle needle being supported in a casing and adapted for obturating the orifices of the nozzle under spring pressure and for opening them under fuel pressure. An abutment which is adjustable in that it reduces the length of the opening stroke of the injection needle when the internal combustion engine operates in a speed range from idling speed to at most a medium speed and under a small load, can be actuated by means of a spring-biased piston urged upon by a pressure medium. In order to guarantee a continuous adjustability of the abutment, the pressure medium acting upon the piston is fed via a pressure-regulating valve, and a control unit, influenced at least by the engine speed and load prevailing at any given time, is provided for controlling this pressure-regulating valve. The piston is arranged in a cylinder having an axis which intersects the axis of the nozzle needle at a first angle slightly deviating from 90°. The abutment is devised as a flattened part of the piston skirt extending in a plane which intersects a plane normal relative to the piston axis at an angle having the same size as the first angle, but opening in a direction opposite to that in which the first angle opens.

4 Claims, 3 Drawing Figures

12
13
(β)
17
3
90°
4
12
17
16
13
14
β
15
11
90°
7
10
8
α
24
25
6
7
25
5
24
10
6
7
9
6
1
9
6
7
9

15
12
(β)
17
3
90°
4
12
17
16
13
14
β
15
11
7
90°
10
8
α
24
25
6
7
25
5
24
10
6
7
9
6
7
6
9
9
1

FUEL INJECTION NOZZLE FOR INTERNAL COMBUSTION ENGINES

BACKGROUND OF THE INVENTION

This invention relates to a fuel injection nozzle for internal combustion engines and comprises a nozzle needle or pin supported in a casing and adapted for closing the orifices of the nozzle under the urgency of spring pressure and for opening them under fuel pressure. The movement of the nozzle is, being limited by stopping means, as well as by abutment means to limit the length of the opening path of the injection pin. The nozzle need is adjustable to reduce that length at idling speed, or at most at medium speed, and under a small load on the fuel combustion engine, the abutment means can be actuated by means of a spring-biassed piston being acted upon by a pressure medium.

A fuel injection nozzle of this type, for internal combustion engines, is described in German Offenlegungsschrift No. 2,558,766 (corresponding to U.S. Pat. No. 4,136,654) in which nozzle there is provided a piston which is arranged transversely to the axis of the valve pin and is displaceable hydraulically, against the action of a spring, while the surface of the piston skirt has a stepped shoulder serving as a stop for limiting the stroke of the valve pin. In this type of fuel injection nozzle, the cross sectional area opening in the injection nozzle should be smaller at idling speed and under a small partial load than under a greater load. At a greater load and speed, there should be available in the injection nozzle an opening of the greatest possible cross sectional area.

It is, however, a drawback of this known injection nozzle that the abutment means are adjustable only between one or the other of two determined end positions which causes an abrupt change in the amount of injected fuel and thereby influences unfavorably the running of the motor. When the nozzle pin hits upon a slanted segment of the piston skirt, the needle can be in a completely undefined position as the slanted face of the piston skirt segment will impart a moment of, for instance, transverse forces to the needle which may cause jamming of the needle in its guide. As, moreover, the needle is not guided in the vicinity of the piston and protrudes beyond a guide, in the nozzle body, provided at a considerable distance from the piston, it will be laterally deflected when hitting against the slanted portion of the skirt surface of the piston.

OBJECTS AND SUMMARY OF THE INVENTION

It is, therefore, an object of the invention to avoid the above-mentioned drawbacks, and to provide a fuel injection nozzle which is improved in such a manner that a continuous adjustability of the abutment means over the entire operational range of the internal combustion engine is assured, together with a uniform, improved fuel emission behavior thereof in this range.

This object is attained in accordance with the invention by providing that the pressure medium acting upon the piston in the initially described fuel injection nozzle is passed through a pressure-regulating valve and that there is provided at least one control unit for this pressure-regulating valve, which unit is influenced at least by the momentarily prevailing engine speed and load, with the piston being arranged in a cylinder whose axis intersects the axis of the nozzle pin and forms together with the latter an angle deviating slightly from 90°, and the abutment means being devised as a flattened part of the piston skirt, which part extends in a plane forming with a plane normal to the piston axis an angle of the same size, but opening in the opposite direction as the first-mentioned angle.

This arrangement of an obliquely flattened piston in a slightly slanted cylinder offers the advantage that the abutment face constituted by the flattened piston skirt part can be shifted by a displacement of the piston. Thereby, the shifting of the flattened piston part is a parallel one, and the part will extend, in any random position of the piston, in a plane normal to the needle axis, so that no transverse forces will occur at the place of contact between the abutment face and the needle which would impart a momentum to the latter, and a tilting, jamming or lateral deviation of the needle is safely avoided.

The pressure-regulating valve influenced by the control unit affords an adaptation to the prevailing operational conditions and thereby a continuous adjustment of the abutment.

BRIEF DESCRIPTION OF THE DRAWINGS

Further objects and advantages of the invention will become apparent from the following more detailed description thereof in connection with the accompanying drawings in which.

DETAILED DESCRIPTION OF THE EMBODIMENT SHOWN IN THE DRAWINGS

Figure 1:
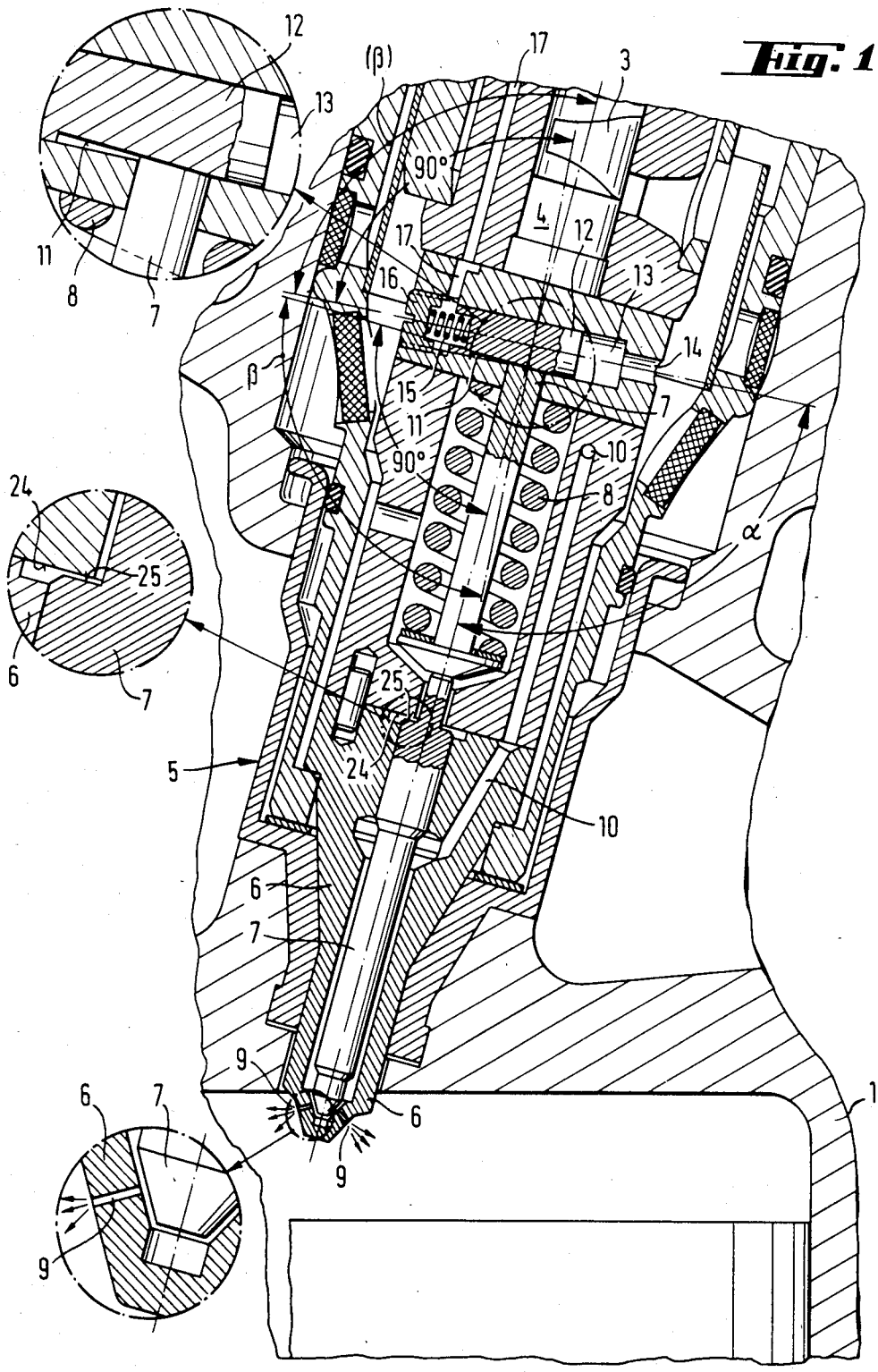
FIG. 1 shows in axial sectional view, on an enlarged scale, the parts relevant to the invention, of a fuel injection nozzle mounted in a cylinder of an internal combustion engine with parts in closed position.
Figure 1A:
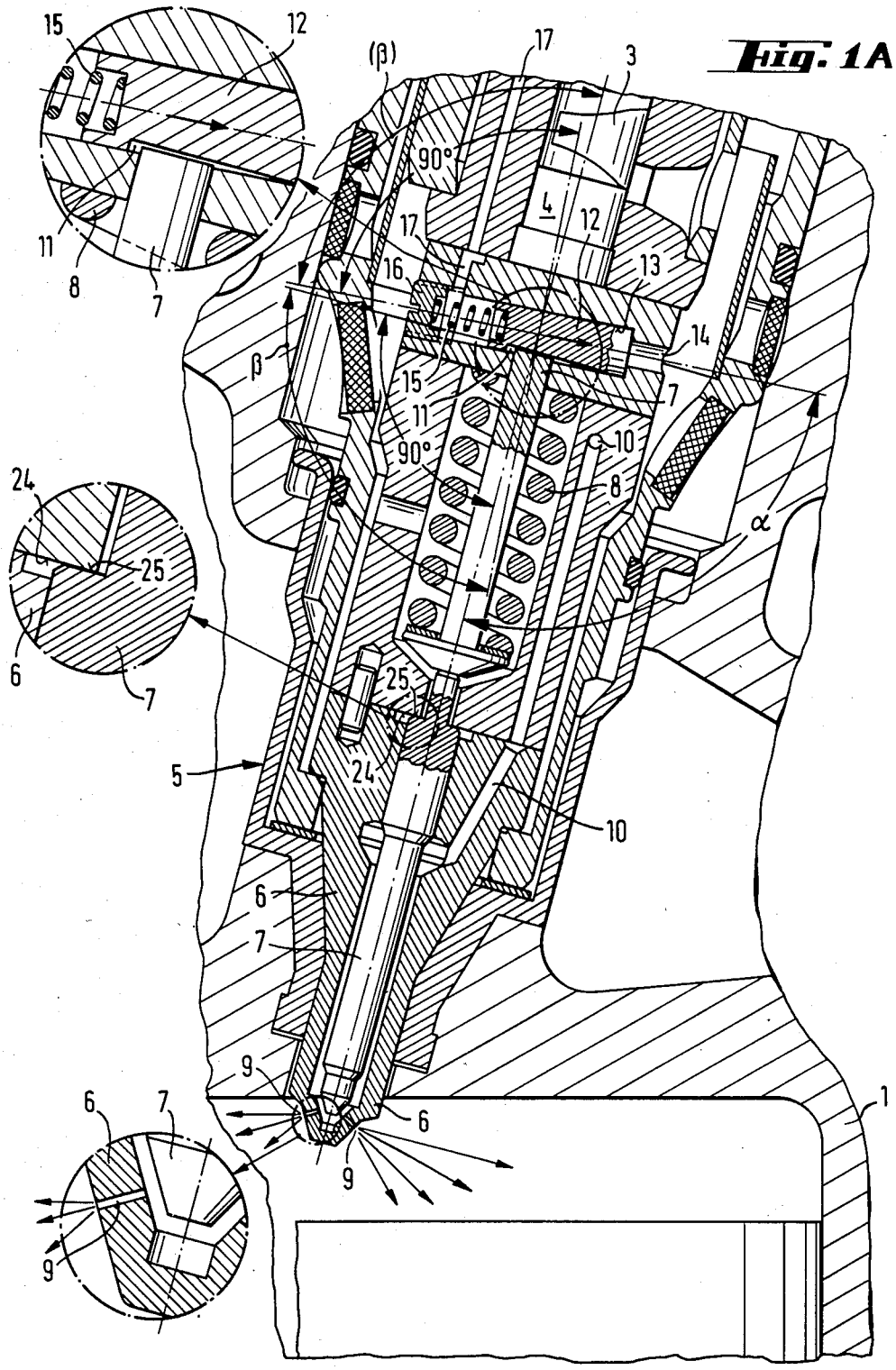
FIG. 1A is an enlarged partial view of a region indicated by IA in FIG. 1, with the parts in open position.
Figure 2:
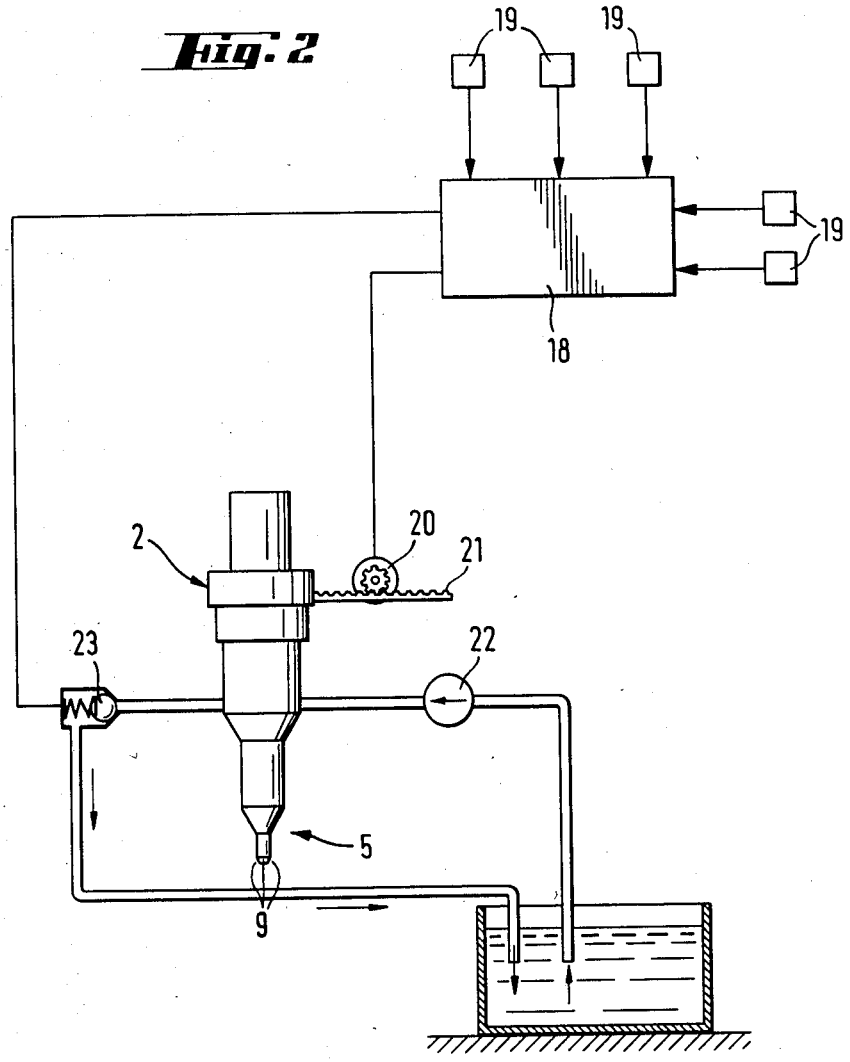
FIG. 2 is a schematical diagram of the regulating means for such a fuel injection nozzle.

Each cylinder 1 of an internal combustion engine is associated with an injection pump-and-nozzle set 2 which consists of a fuel injection pump comprising a piston 3 and a cylinder 4 as well as an injection nozzle 5 which comprises a nozzle needle 7 supported in a casing 6. The nozzle needle or pin 7 is held by means of a strong spring 8 in a position in which it obturates the nozzle orifices 9. Fuel is forced from the cylinder 4 of the pump into the lower part of the casing 6 via a system of ducts 10, whereby the nozzel pin 7 is lifted off its conical seat above the nozzle orifices 9 against the urgency of the spring 8, and fuel is injected into the combustion chamber. This results in the formation of a throttle gap between the conically beveled tip of the nozzle pin and the conical seat therefor.

An abutment limiting the length of the opening path of the nozzle pin 7 is constituted by a flattened part 11 of the skirt of a piston 12. The piston 12 is housed in a cylinder 13 whose axis intersects the nozzle axis at an angle $\alpha$ which deviates slightly from 90°. The plane of the flattened part 11 and the plane normal with regard to the piston axis enclose between them an angle $\beta$ of equal size but opening in the opposite direction to the direction in which angle $\alpha$ opens. Pressure of the fuel fed to the nozzle pump 3,4 acts via a bore 14 on the piston 12 which is supported, on the other hand, on an adjusting screw 16 by means of a spring 15. The cylinder space on the same piston as the spring 15 is vented via a duct system 17.

A control unit 18 which is fed operational data such as, for instance, the speed of the crankshaft, the position of the accelerator pedal as a measure of the load, the air and engine temperatures and so forth, via the respective sensors 19, controls, via a stepping motor 20 and a rack-and-pinion drive 21, the delivery rate of the fuel pump of the injection set 2 by turning of the pump piston 3 which bears control edges. Fuel is delivered to the injection pump from a simple booster pump 22. The reference numeral 23 designates a pressure-regulating valve which is devised as a threshold control and is actuated by the control unit 18 regulating the so-called inlet pressure of the fuel, i.e., the pressure of the fuel when arriving at the injection pump 3,4. The control unit 18 and the pressure-regulating valve 13, respectively, are adjusted in such a manner that the inlet pressure is low at full load and high speed, amounting, for instance to only one bar, while when idling or at low speed, respectively, or with a small load, it is substantially higher and may amount to 5 bar.

As this inlet pressure is exerted on the piston 12 against the bias of the spring 15, the piston 12 is displaced, at idling or low speed and with small load, to the position illustrated in FIG. 1, in which position the nozzle pin 7 will contact the flattened piston part 11 already after a short stroke, and fuel injection will be delayed due to the narrowed throttle passage. When, however, the inlet pressure decreases at higher speeds or under full load, respectively, then, the spring 15 will push the piston 12 to the right-hand side in FIG. 1, and the flattened piston part 11 which serves as an abutment face will afford a free space permitting a substantially longer stroke of the injection pin 7. However, in this case, when the the piston 12 is displaced to the right and the flattened abutment face 11 registers with the pin 7, an annular shoulder 25 formed by an enlarged diameter portion of the needle 7, will abut against a fixed stop 24 provided in the casing 6 before the upper pin end can come into contact with the flattened piston part 11.

I claim:

1. A fuel injection nozzle for an internal combustion engine having a nozzle needle disposed in a casing having nozzle orifice means, said nozzle needle being movable in said casing to carry out an axial stroke to open and close said nozzle orifice means, said axial stroke being carried out under pressure from the fuel supply, the length of said axial stroke being adjustable by a piston disposed in a piston cylinder, and pressure regulating means associated with said piston for conveying fuel to said piston cylinder for adjusting the position of said piston, wherein said pressure regulating means includes control means for detecting the working conditions of said engine and for generating signals in response thereto, and a pressure regulating valve responsive to said signals from said control means, wherein said piston cylinder is disposed at an angle to the axis of said nozzle needle, said angle slightly deviating from 90°, and wherein said piston includes an abutment face associated with said nozzle needle for limiting the length of said axial stroke, said abutment face being a flat, step-less surface and forming a second angle with a plane normal to said nozzle needle axis, said second angle being equal to but opening in the opposite direction to said first angle.

2. A fuel injection nozzle adapted for use in an internal combustion engine, which nozzle comprises:

(a) a casing; (b) a nozzle needle operable between open and closed positions supported in said casing; (c) nozzle orifice means obturated by said needle when in closed position; (d) spring means biasing said needle into the closed position;

said nozzle needle being adapted for an axial stroke opening said nozzle orifice means against the bias of said spring means, and having a needle axis;

(e) conduit means connected with said casing and adapted for feeding fuel under pressure thereinto to act on said nozzle needle for carrying out said opening stroke;

(f) a cylinder having a cylinder axis intersecting said needle axis under a first angle slightly deviating from 90°;

(g) a piston lodged in said cylinder and having a piston axis; said piston including piston spring means for biasing said piston and a piston skirt having a continuous flat part formed on the external surface thereof, said flattened part extending in a plane forming with a plane normal to said piston axis a second angle being of the same size as said first angle but opening in a direction opposite that in which said first angle opens;

(h) abutment means comprising said flattened piston skirt part facing toward said nozzle needle and being adapted for limiting said opening stroke of said nozzle needle; and (i) means for adjusting the position of said abutment means relative to said nozzle needle, said position adjustment means comprising (1) a control unit adapted for detecting the working conditions of said engine prevailing at a given time and for generating signals in response thereto;

(2) a pressure-regulating valve adapted to be controlled by said control unit; and (3) feeding line means adapted for feeding a pressure medium via said pressure-regulating valve into said cylinder to act therein on said piston against the bias of said piston spring means, whereby said axial stroke of said nozzle needle is continuously adjustable over the working range of said engine.

3. The fuel injection nozzle of claim 2, wherein said abutment means further comprises stop means associated with said casing and said nozzle needle and being adapted for arresting the opening stroke of said nozzle needle prior to the later coming into contact with said flattened piston skirt part.

4. The fuel injection nozzle of claim 3, wherein said needle has an enlarged diameter portion forming an annular shoulder and said shoulder abuts against said stop means.

* * * * *